United States Patent [19]

Kambe

[11] Patent Number: 4,826,350

[45] Date of Patent: May 2, 1989

[54] METHOD FO CONSTRUCTING WATER-PERMEABLE SPORTSSURFACE AND THE LIKE

[75] Inventor: Hiroyuki Kambe, Tsuyama, Japan

[73] Assignee: Nisshoku Corporation, Tsuyama City, Japan

[21] Appl. No.: 159,275

[22] Filed: Feb. 25, 1988

[30] Foreign Application Priority Data

Mar. 7, 1987 [JP] Japan ..... 62-52380

[51] Int. Cl.[4] ..... E01C 13/00

[52] U.S. Cl. ..... 404/27; 404/31; 404/76; 404/81

[58] Field of Search ..... 404/27, 31, 72, 75, 404/76, 81, 92; 405/264, 266, 271

[56] References Cited

U.S. PATENT DOCUMENTS

| | | | |
|---|---|---|---|
| 2,588,248 | 3/1952 | Klein | 405/264 |
| 2,937,581 | 5/1960 | Havelin et al. | 404/76 |
| 3,131,074 | 4/1964 | Thompson, Jr. | 404/76 X |
| 4,072,020 | 2/1978 | Bishop | 404/76 X |
| 4,106,296 | 8/1978 | Leonard, Jr. et al. | 404/75 X |
| 4,134,862 | 1/1979 | Eden et al. | 405/264 X |
| 4,238,241 | 12/1980 | Schneider | 106/281 R |
| 4,465,518 | 8/1984 | Miyoshi et al. | 404/76 X |

*Primary Examiner*—Thuy M. Bui
*Assistant Examiner*—Matthew Smith
*Attorney, Agent, or Firm*—Price, Gess & Ubell

[57] ABSTRACT

A soil, which has been regulated in particle-diameter, is blended with a hydraulic material and water or an aqueous solution of synthetic resin emulsion, so that a moisture content may be 1.2 to 1.5 times an optimum soil compacting moisture content, and then stirred and followed by subjecting to a rolled fill which is followed by watering or spreading an aqueous solution of a soil-agglomerating agent on the mixture, which was subjected to the rolled fill, at least one time within 1 to 5 days after the completion of the rolled fill and further watering at least one time within 7 to 21 days after the completion of the rolled fill respectively, whereby an ideal sportssurface and the like showing not only a water-permeability but also a preferable compression strength and bending strength and showing no frost heaving is obtained.

15 Claims, No Drawings

METHOD FO CONSTRUCTING WATER-PERMEABLE SPORTSSURFACE AND THE LIKE

BACKGROUND OF THE INVENTION

1. Field of the Invention

The present invention relates to a method of constructing a sportssurface and the like having a compression strength, a bending strength, permeable to water, and showing no frost heaving.

2. Description of the Prior Art

A sportssurface in various kinds of sportsground, a sidewalk, a jogging course and the like have shown a problem in that their useable season and time are limited due to the weakening of a ground surface by rainwater.

In addition, recently, a lower layer road bed of a sportsground constructed with an artificial lawn or an artificial lawn filled with dried sands has been investigated.

So, the present inventor has tried to apply a soil-cement construction method to the above described sportssurface, lower layer road bed with an artificial lawn, sidewalk, jogging course and the like.

It has been, however, found that in the case where this soil-cement construction method is used for the formation of the above described sportssurface and the like, the following fatal disadvantages occur. That is to say, since soil-cement is naturally not permeable to water, a surface of a soil formed by said soil-cement construction method is remarkably wanting in water-permeability; the surface of the soil shows a frost heaving in an area where a temperature reaches below the freezing point; and the surface of the soil is broken due to coldness.

However, with regard to a relation between the water-permeability and the compression strength of soil cement, the compression strength is reduced with an increase of the water-permeability while the water-permeability is reduced with an increase of the compression strength; that is, an opposite relation exists between the water-permeability and the compression strength of soil-cement. Therefore, it is very difficult to solve the above described disadvantages.

In addition, since the water-permeability and the compression strength having a suitable bounding property and a cushiony property are required for a clay tennis-court, a sportssurface is most difficult to form.

The present inventor is a technician in the field of civil engineering and sports facilities and sufficiently knows that in order to use soil-cement in the formation of a sportssurface and the like, the above described disadvantages of soil-cement must be overcome.

However, the inexpensiveness of a soil constructed from soil-cement is incomparably attractive, so that the present inventor has ventured to challenge the above described difficulty and repeated the investigation for a long time. And, this time the present inventor obtained novel ideas through his investigation and experiments and achieved the present invention on the basis of the novel ideas.

SUMMARY OF THE INVENTION

The construction of the present invention is below described in detail.

A soil within a range of SL [sandy loam] to LS [loamy sandy] in a triangular diagram of the International Soil Quality Association is generally used in the construction method according to the present invention. Such a soil is easy to blend with a hydraulic material and has a property of being apt to increase the compression strength when subjected to compaction.

However, in the case where the soil used contains soil particles having a diameter of 105 microns or less at a ratio of 5% or more by weight, the soil having a soil property within the range of SL to LS is coagulated by blending the soil with the hydraulic material in a pretreatment to regulate a particle-diameter followed by use.

One example of this case is described. 1 $m^3$ of soil having a soil property of SL containing soil particles having a particle-diameter of 105 microns or less at a ratio of 30% by weight was blended with 30 kg of cement while regulating the water-containing ratio so as to be 10 to 25% by weight and the resulting mixture was left unattended for 24 hours to obtain a soil in which almost all particles were regulated at 105 to 4,000 microns in diameter. This soil was tested on the hydraulic screening with a result that particles having a diameter of 105 microns or less were contained at a ratio of 4.1% by weight.

In addition, the hydraulic material according to the present invention includes a material, such as gypsum, lime and the like, hardened with water in addition to cement.

In addition, a synthetic resin emulsion, which will be mentioned later, includes for example an ethylene-vinyl acetate emulsion, acryl emulsion, vinyl acetate emulsion and latex, and a soil-agglomerating agent includes for example polyethylene oxide, polyacrylamide, polyolefine and polyvinyl acetate.

DESCRIPTION OF THE PREFERRED EMBODIMENT

1 $M^3$ of soil having a soil property within a range of SL to LS is regulated in a water-containing ratio so as to be 10 to 25% by weight and blended with 30 kg of cement to regulate particle-diameter.

An optimum soil compacting moisture content of a soil having a soil property within a range of SL to LS amounts to a particle size distribution of about 6 to 15% on a side of LS and about 15 to 25% on a side of SL.

1 $m_3$ of soil having an optimum of soil compacting moisture content of 17% was blended with 100 kg of cement and the resulting mixture was watered so that the moisture content of the soil might amount to 21.7%, which was 1.28 times the optimum soil compacting moisture content. In addition, the mixture was stirred and then subjected to a rolled fill 4 to 5 times by means of a 4-ton roller. A water-permeability coefficient $4\times10^{-4}$ cm/sec was achieved and a compression strength of 17 kg/$cm^2$ was achieved.

In addition, in this case, it is sufficient that the soil is merely watered but the addition of an aqueous solution of synthetic resin emulsion at a ratio of 10 to 20 kg based on 1 $m^3$ of the soil leads to a more increased compression strength. As to this point, it is important that when the hydraulic material and the soil are compacted at the optimum soil compacting moisture content, the compression strength can not be obtained but the water-permeability can be obtained. When compacted at the moisture content below the optimum soil compacting moisture content, the superior water-permeability can be obtained but the compression strength is remarkably reduced. In addition, when they are compacted at the moisture content above 1.5 times the optimum of oil compacting moisture content, both the water-permeability and the compression strength are reduced.

And, when they are compacted at the moisture content 1.2 to 1.5 times the optimum of soil compacting moisture content, the preferable compression strength can be obtained while maintaining the superior water-permeability.

Next, in order to heighten the bending strength of soil surface and prevent the breakage of soil surface due to coldness, it is preferable to water the soil surface at a ratio of 1 to 2 liters/$m^2$ 1 to 5 days after the completion of rolled fill and cure under a sheet. In the case where the soil surface was not watered at an age of 28 days, the bending strength of soil surface was 2.7 kg/$cm^2$. On the contrary, in the case where the soil surface was watered, the bending strength could be remarkably increased up to 3.4 kg/$cm^2$.

In addition, if the soil surface is watered within 1 to 5 days after the completion of construction, the soil and cement are not strongly hardened according to circumstances. Then a 0.03 to 0.05%-aqueous solution of the soil-agglomerating agent, such as polyethylene oxide, is spread. At this time, since no muddy water is produced, the effect becomes more notable.

Next, a method of preventing the frost heaving is described. Generally speaking, it has been said that a soil having a value of compression strength of 20 kg/$cm^2$ or more shows a frost heaving-suppressing effect.

It is necessary for an increase of the compression strength of soil up to the value to water, a surface subjected to a rolled fill, at least one time at a ratio of about 1.5 to 2 liters/$m^2$ within 7 to 21 days. If so, the water-permeability does not vary but the compression strength can be remarkably increased up to 28.0 kg/$cm^2$ at an age of 28 days.

The above described method led to the acquirement of a soil having water-permeability, showing no frost heaving, and showing no breakage of the surface thereof due to coldness.

A method of constructing a clay tennis-court and the lower layer road bed of sportsground using an artificial lawn is below described.

At first, it is determined whether the field is subjected to the floor-piling or the floor-digging. Both the floor-piling and the floor-digging are carried out by about 30 cm. The floor-piling on the field is below described with reference to an example.

Broken stones or a decomposed granite soil having a particle size of 40 mm or less are laid on a foundation of the field in a thickness of 15 cm and subjected to a rolled fill by means a roller.

A soil having a moisture content of 10 to 40% and containing soil particles having a diameter of 105 microns or less at a ratio of 5% or more by weight is regulated in particle-diameter by using cement in the pretreatment. Then, leveled paving of stone on the above described broken stones or the like, which were already subjected to the rolled fill, is layed in a thickness of about 15 cm. Subsequently, cement is spread on the soil at a ratio of 100 kg/$m^3$ and then, the soil and cement are blended by means of a tractor or the like. The moisture content of the blended soil is measured and an aqueous solution of ethylene vinyl acetate emulsion is added to the soil at a ratio of 15 kg based on 1 $m^3$ of soil so that the moisture content may amount to 1.2 to 1.5 times the optimum of soil compacting moisture content and the soil mixture is again stirred by means of a tractor or the like. Subsequently, the resulting soil is subjected to a temporary rolled fill 2 to 3 times by means of a 4-ton roller to remove an unevenness and then subjected to the main rolled fill to finish the rolled fill.

After the completion of said rolled fill, in order to heighten the bending strength of the soil surface, a 0.04%-aqueous solution of polyethylene oxide is spread on the soil surface at least one time at a ratio of 1 to 2 liters/$m^2$ 1 to 5 days after the completion of the rolled fill and cured under a sheet. Further, in order to heighten the compression strength, water is spread on the soil surface 1 to 2 times at a ratio of 1.5 to 2 liters/$m^2$ for 7 to 21 days after the completion of the rolled fill.

The present inventor carried out a trial construction on the field in a ground owned by the applicant in October, 1986 under the condition that admittance was prohibited to the persons outside the company, and investigated the wintering condition in the middle ten days of February, 1987 with the results that no frost heaving was shown, the compression strength was 28.3 kg/$cm^2$, the bending strength was 3.7 kg/$cm^2$, and the water-permeability coefficient was $4\times10^{-4}$ cm/sec, almost similar to those for an age of 28 days.

In addition, the general clay court, to which the present invention was not applied, constructed on the same ground showed a perfect frost heaving and was weakened to such an extent that it could not be used on account of rain water.

As above described, the present invention relates to a method of constructing a water-permeable sportssurface, and the like, characterized by that, at first a soil having a moisture content of 10 to 40% and containing soil particles having a particle-diameter of 105 microns or less at a ratio of 5% or more by weight is blended with a hydraulic material in the pretreatment to regulate the mixture in particle-diameter so that a soil property may be within a range of SL to LS. Then said soil, which was regulated in particle-diameter, is blended with the hydraulic material and water, so that the moisture content may be 1.2 to 1.5 times an optimum of soil compacting moisture content, and then stirred and followed by subjecting it to a rolled fill. The process is then followed by watering the mixture, which was subjected to the rolled fill, at least one time within 1 to 5 days after the completion of the rolled fill and further watering at least one time within 7 to 21 days after the completion of the rolled fill. A method of constructing a water-permeable sportssurface and the like, characterized by that, at first, a soil having a moisture content of 10 to 40% and containing soil particles having a particle-diameter of 105 microns or less at a ratio of 5% or more by weight is blended with a hydraulic material in the pretreatment to regulate the mixture in particle-diameter so that a soil property may be within a range of SL and LS. Then said soil, which was regulated in particle-diameter, is blended with the hydraulic material and an aqueous solution of synthetic resin emulsion, so that the moisture content may be 1.2 to 1.5 times an optimum soil compacting moisture content, and the resulting mixture is stirred and followed by subjecting it to a rolled fill which is followed by spreading an aqueous solution of a soil-agglomerating agent on the mixture, which was subjected to the rolled fill, at least one time within 1 to 5 days after the completion of the rolled fill and further watering at least one time within 7 to 21 days after the completion of the rolled fill. So that not only a desired compression strength can be obtained by adding water so that the moisture content may be 1.2 to 1.5 times the optimum of soil compacting moisture content but also a desired bending strength and a water-permeability can be given to a soil surface since water is spread on the soil surface at least one time at a ratio of 1 to 2 liters/$m^2$ within 1 to 5 days after the completion of the rolled fill.

In addition, in order to heighten the compression strength, water is spread on the soil surface at least one time at a ratio of 1.5 to 2 liters/$m^2$ within 7 to 21 days after the completion of the rolled fill, so that the compression strength can be remarkably increased without reducing the water-permeability and also the frost heaving-preventing effect can be achieved.

Accordingly, although the water-permeability and the like have never been thought in the conventional soil-cement construction method, according to the present invention, special effects can be exhibited in that an ideal sportssurface permeable to water having a preferable compression strength and bending strength and showing no frost heaving can be obtained. In addition, it is economical and inexpensive, similar to the conventional soil-cement construction method. The water-permeability and excellent drainage achieved, in spite of the moderate compression strength, are useful for sportssurfaces of various kinds of sportsgrounds (in particular a clay tennis court), sidewalks, jogging courses or a lower layer road bed of sportsground using an artificial lawn. Also, no frost heaving is shown even at temperatures below the freezing point, and in addition, the bending strength is better and no surface breakage occurs. Therefore, the method can be applied also to the fields to which the conventional soil-cement construction method has never been applied.

What is claimed is:

1. A method of constructing a water-permeable sportssurface and the like, characterized by providing a soil having a moisture content of 10 to 40% and containing soil particles having a particle-diameter of 105 microns or less at a ratio of 5% or more by weight; blending said soil with a hydraulic material to regulate a mixture in particle-diameter so that a soil property may be within a range of SL to LS in a pretreatment; blending said soil, which was regulated in particle-diameter, with the hydraulic material and water so that the moisture content may be 1.2 to 1.5 times an optimum soil compacting moisture content described by about 6 to 15% on a side of LS and about 15 to 25% on a side of SL, stirring said soil having 1.2 to 1.5 times the optimum soil compacting moisture content; subjecting the stirred soil to a rolled fill; and watering the mixture, which was subjected to the rolled fill, at least one time within 1 to 5 days after the completion of the rolled fill and further watering at least one time within 7 to 21 days after the completion of the rolled fill.

2. A method of constructing a water-permeable sportssurface and the like, characterized by providing a soil having a moisture content of 10 to 40% and containing soil particles having a particle-diameter of 105 microns or less at a ratio of 5% or more by weight; blending said soil with a hydraulic material to regulate a mixture in particle-diameter so that a soil property may be within a range of SL to LS in a pretreatment; blending said soil, which was regulated in particle-diameter, with the hydraulic material and an aqueous solution of synthetic resin emulsion so that the moisture content may be 1.2 to 1.5 times an optimum soil compacting moisture content of about 17%; stirring the resulting mixture having a moisture content of 1.2 to 1.5 times the optimum compacting moisture content; subjecting the stirred mixture to a rolled fill; spreading an aqueous solution of a soil-agglomerating agent on the stirred mixture, which was subjected to the rolled fill, at least one time within 1 to 5 days after the completion of the rolled fill; and watering at least one time within 7 to 21 days after the completion of the rolled fill.

3. The method of constructing a sportssurface according to claim 1 or 2 wherein said hydraulic material is one of gypsum and lime, which is hardened with water and cement.

4. The method of constructing a sportssurface according to claim 1 or wherein said moisture content is about 1.28 times said optimum soil compacting moisture content.

5. The method of constructing a sportssurface according to claim 1 or 2 wherein said watering on the mixture within 7 to 21 days is accomplished at a ratio of about 1.5 to 2 liters/$m^2$.

6. The method of constructing a sportssurface according to claim 1 wherein said watering on the mixture within 1 to 5 days is accomplished at a ratio of about 1 to 2 liters/$m^2$.

7. The method of constructing a sportssurface according to claim 2 wherein said synthetic resin emulsion includes one of an ethylene-vinyl acetate emulsion, an acryl emulsion, a vinyl acetate emulsion, and a latex.

8. The method of constructing a sportssurface according to claim 2 wherein said synthetic resin emulsion is added in a ratio of about 10 to 20 kg per cubic meter of soil.

9. The method of constructing a sportssurface according to claim 2 wherein said soil-agglomerating agent includes one of polyethylene oxide, polyacrylamide, polyolefine, and polyvinyl acetate.

10. A sportssurface, comprising:

a soil mixture having particles whose diameters are not more than about 105 microns;

a hydraulic material blended in said soil mixture to regulate particle diameter; and water mixed in said soil mixture and hydraulic material, said water also being thereafter added at two time periods following a rolled fill of the blended soil mixture and hydraulic material, said two time periods are described at 1 to 5 days after a rolled fill and 7 to 21 days after said rolled fill, said water being added at ratios of about 1 to 2 liters/$m^2$ and 1.5 to 2 liters/$m^2$, respectively, for said time periods.

11. The sportssurface according to claim 10 wherein said hydraulic material is one of gypsum and lime.

12. The sportssurface according to claim 10 wherein said blended soil mixture and hydraulic material has been subjected to a rolled fill about 4 to 5 times.

13. The sportssurface according to claim 10 wherein said optimum soil compacting moisture content is about 17%.

14. The sportssurface according to claim 13 wherein said moisture content is about 1.2 to 1.5 times said optimum soil compacting moisture content.

15. The sportssurface according to claim 10 wherein the two time periods are described at 1 to 5 days after a rolled fill and 7 to 21 after said rolled fill.

* * * * *